US005266163A

United States Patent [19]

Dessauer

[11] Patent Number: 5,266,163

[45] Date of Patent: Nov. 30, 1993

[54] PROCESS FOR THE TREATMENT OF A PIGMENT SUSPENDED IN WATER AND METHOD OF MANUFACTURING PAPER

[75] Inventor: Guido Dessauer, Tutzing, Fed. Rep. of Germany

[73] Assignee: Rohm GmbH, Darmstadt, Fed. Rep. of Germany

[21] Appl. No.: 793,379

[22] PCT Filed: May 8, 1991

[86] PCT No.: PCT/DE91/00376

§ 371 Date: Jan. 6, 1992

§ 102(e) Date: Jan. 6, 1992

[87] PCT Pub. No.: WO91/18148

PCT Pub. Date: Nov. 28, 1991

[30] Foreign Application Priority Data

May 12, 1990 [DE] Fed. Rep. of Germany ..... 4015252

[51] Int. Cl.[5] ..... D21H 17/69

[52] U.S. Cl. ..... 162/168.1; 162/181.1; 162/181.2; 162/181.3; 162/183

[58] Field of Search ..... 162/168.1, 181.1, 181.2, 162/183, 181.3; 106/499

[56] References Cited

U.S. PATENT DOCUMENTS

| | | | |
|---|---|---|---|
| 4,282,059 | 8/1981 | Davidson | 162/183 |
| 5,030,325 | 7/1991 | Saji et al. | 162/181.1 |

FOREIGN PATENT DOCUMENTS

| | | | |
|---|---|---|---|
| 234513 | 9/1987 | European Pat. Off. . | |
| 263519 | 4/1988 | European Pat. Off. . | |
| 279313 | 8/1988 | European Pat. Off. . | |
| 57-35097 | 2/1982 | Japan | 162/181.2 |
| 1353015 | 5/1974 | United Kingdom | 162/181.2 |

*Primary Examiner*—Peter Chin

*Attorney, Agent, or Firm*—Oblon, Spivak, McClelland, Maier & Neustadt

[57] ABSTRACT

Pigments for the papermaking industry, in particular kaolin, are treated with a high molecular polymerizate that is solvated by means of carboxylate groups and belongs to an ethylenically unsaturated, radically polymerizable carboxylic acid as the binder. By gradually adding an acidifying agent the binder is coacervated and totally precipitated on the pigment. It is important that the quantity of the acidifying agent is limited in such a manner that the pigment retains a negative surface charge and the coacervate still contains water. With the pigment treated thus printing papers with increased pigment content and/or increased breaking strength can be manufactured.

12 Claims, No Drawings

PROCESS FOR THE TREATMENT OF A PIGMENT SUSPENDED IN WATER AND METHOD OF MANUFACTURING PAPER

The invention relates to a process for the treatment of a pigment, suspended in water and intended for the papermaking industry, with an aqueous binder or the pigment treated thus. Furthermore, the invention relates to a process for the manufacture of pigment-containing paper with increased resistance to tearing or with increased pigment content.

PRIOR ART

For over one hundred years it has been common practice in the manufacture of printing papers to coat the surface in order to obtain a good printing view. The coated papers are also called art paper. Machine coated paper or chrome paper and in the highest quality as enamel paper. The purpose of the coating is to form a layer for the print, which consists exclusively of pigments and a binder. This layer is usually also compacted by means of calendaring and brought to a gloss. It enables the reproduction of the finest dots.

Coating in an expensive process that is usually performed in a separate coating installation after the papermaking machine. Since printing on pigments or pigment layers leads to significantly better printing results than printing on a pure fibre web. For decades there have been efforts to introduce more pigments into the paper directly on the papermaking machine without reducing its resistance to tearing. Thus the expensive coating process could be avoided.

Wood-containing, highly filled, super calendared gravure papers with a pigment content ranging from 17 to 30 wt. % are wide spread. They are called super calendared papers. When they are manufactured, the pigments, usually kaolin or talcum, are bonded adsorptively and filtratively in the fibre web.

To improve the bonding of the pigment, binders have also been already used, e.g. modified starch, carboxymethyl cellulose, alginates, mannogalactans (Meyproid), gelatin and hide glue. They are added into the furnish as colloid solutions and are bonded adsorptively to the pigment and the fiber by means of electrokinetic forces. This bonding is never complete. Therefore, a portion of the added binder, is found in the recycling water and in the waste water of the papermaking plants which portion is thus lost and necessitates a purification of the waste water.

EP-A 50 316 described a paper manufacturing process in which in a first process step an aqueous suspension of an inorganic pigment is treated with a classic organic paper binder such as dextrin, starch, carboxymethyl cellulose, polyvinyl alcohol or polymer dispersions; and the binder is precipitated by means of a cationic flocculent. Suitable flocculants are polycationic compounds such as polyethylene imine, cationically modified polyacrylamides, polyaluminum chloride and cationic starch. The added pigment suspension can optionally contain conventional dispersants such as polyphosphates or sodium polyacrylate; such dispersants do not act as binders.

In the second process step the pigment pretreated thus is added to an aqueous fibre stock and finally the sheet of paper is formed. When forming the sheet, excellent retention of the pigment is achieved, and paper with improved resistance to tearing is obtained.

In a process described in the DE-A 2 115 409 mineral fillers for the papermaking industry are used, primarily calcium carbonate. with a coating made of an organic polymer, wherein primarily the decomposition of the calcium carbonate in the acidic range is to be suppressed. The coating can be formed, e.g., from an aqueous solution of a neutralized acrylic acid polymerizate by means of precipitation with aluminum sulfate. The aluminum ions have the effect of imparting a positive charge to the filler or the pigment and thus intensifying their affinity for the cellulose fibers.

The inventors have found that binders precipitated by means of electrokinetic effects are not bonded so as to be shear stable so that during the subsequent formation of the sheet some binder always gets into the water circuit.

PROBLEM AND SOLUTION

The object of the invention is a process for the treatment of a pigment, suspended in water and intended for the papermaking industry with a binder and subsequent fixation of the binder, forming a pigment suspension, which is suitable for the manufacture of paper with a high pigment content by forming a sheet from an aqueous stock. In so doing, the binder shall be bonded so securely to the pigment that it does not detach again from the pigment and that the aqueous phase of the suspension contains less than 5 wt. % of the binder and the content of the binder in the aqueous phase does not increase even during high-shear treatment.

It has been found that this goal is achieved if a high molecular polymerizate of an ethylenically unsaturated, radically polymerizable carboxylic acid that is solvated by means of carboxylate groups is added as the binder, that an acidifying agent is gradually added to the dissolved binder until the binder coacervates, and the coacervate is precipitated on the suspended pigment, wherein the quantity of the acidifying agent is limited in such a manner that the pigment retains a negative surface charge.

The conversion of the binder, solvated by means of the carboxylate groups, with the acidifying agent has the characteristic of coacervation—without committing the invention to a specific theory. Understood (according to Rompp's Lexikon der Chemie, 9th edition, p. 2770) is the transition of the binder, which was originally present as the dissolved colloid, from the sol state into the solid precipitate. In so doing, it passes through an intermediate state in which the previously uniformly distributed polymer precipitates in its own, still fluid, water-containing phase. Evidently this phase combines with the surface of the pigment particles and passes over into a totally insoluble state with increasing dehydration.

If the treated pigment suspension is allowed to sedimentate following coacervation, the supernatant water is totally clear and shows no Tyndall effect. Therefore, following completion of coacervation, the aqueous phase of the pigment suspension contains no more binder. In any case the aqueous phase contains less than 5 wt. %, usually even less than 1 wt. % of the binder that was originally added. Often with customary methods of detection. e.g. CSB measurement, no organic substance content beyond the zero value can be found in the supernatant aqueous phase. This applies even more so to the backwater of the formation of the sheet, when the pigment suspension treated according to the invention is added to the fibrous material for the manufacture of a pigment-containing paper. In laboratory tests CSB values of the aqueous phase below 50 in part below 30 were obtained; in the backwater in part below 15.

Surprisingly the adhesion of the binder to the pigment proves to be shear stable. Even if the pigments treated according to the invention are subjected for a prolonged period of time to high shear forces, the binder is not detached again from the pigment particles and the aqueous phase remains free of the added binder. As a rule the binder content increases in the aqueous phase during shear treatment with an intensive mixer according to Prof. Wilms ("Ultraturrax" ®, manufacturing company Janke & Kunkel) within 3 minutes at 4.000 rpm to no more than 5 wt. %, based on the total binder content of the suspension.

For the coacervation process characterizing the invention it is important that the pigment particles are added in the anionic form in which they are normally present and are not shifted to cationic charge during coacervation.

An agglomeration and flocculation of the pigments based on electrokinetic attraction forces would be a drawback and may occur—if at all—only to a small degree. The electric charge state of the particles, which is also called the zeta potential, can be recognized by their migration behavior in the electric field. Charged particles with a negative zeta potential migrate to the anode during electrophoresis.

It is important that the polymer is not totally dehydrated during the gradual process of coacervation. The goal is a solvation state ranging between total solvation of the solution state and the desolvated state of a hard and solid precipitate. This state is achieved by approaching the isoelectric point without, however, exceeding it. The perservation of adequate solvation, which acts to plasticize and elastify the polymer, is important for its bonding power.

Total solvation of the polymer is not absolutely necessary at the start of the process. Often a limited solvation that allows at least a colloid solution state suffices.

Through the addition of acidifying agents the degree of neutralization and thus also solvation decreases. The binder becomes increasingly less soluble and starts to separate as a water-containing phase from the surrounding aqueous phase. That is the start of coacervation. It is continued until a solvation state is reached in which the insoluble coacervate has totally precipitated on the surface of the pigment particles, but still contains enough water to unfold a high bonding strength. Not until the formed sheet is dried does the binder change into a solid state and unfold its binding and strengthening effect.

During coacervation local over-acidification must be avoided if possible. It would lead to severely dehydrated portions of low binding power or to the formation of flocs. In any case the pigment suspension is not to be added to the solution of the acidifying agent, because then excess acidifying agent would then be temporarily present. While stirring, the acidifying agent is added as uniformly distributed as possible at a speed that keeps pace with the reaction with the polymer. To avoid uneconomically long coacervation periods, it is advantageous to stir as intensively as possible.

The coacervate can be solvated again or even rendered soluble by means of renewed neutralization. That is important for the recovery of waste paper.

APPLICATION OF THE TREATED PIGMENT SUSPENSION

The pigment suspension treated according to the invention is suitable for the manufacture of papers with high pigment content on papermaking machines. The highest strength values are achieved if the treated suspension is worked into the fibrous material. Optionally one can also proceed in such a manner that in the proportioning system of the papermaking machine the pigment, the binder and the fibrous material are mixed and coacervation is effected through the addition of the acidifying agent to this mixture. Similarly the binder can be worked into the alkaline fibrous material, then the pigment is added and subsequently coacervation is performed. Then the sheet is formed by conventional methods on the foundrinier wire. Preferably the paper is subsequently calendared.

In this manner papers with a total pigment content of up to 45 wt. %, preferably from 17 to 35 wt. %, are obtained. In the extreme case the pigment content can be raised even higher; even contents of 60 wt. % can be obtained. With respect to the high pigment content the breaking length of the paper—as a characteristic variable of its strength—is astonishingly high. Thus, the invention permits papers with conventional high pigment contents and increased breaking length or papers with conventional breaking length and significantly increased pigment content to be manufactured. The latter means a reduction in cost, since the pigments are usually less expensive than the fibrous material, and simultaneously an improvement in the quality of the printing properties due to the high pigment content.

The pigment suspension treated according to the invention can also be used optionally to coat papers.

THE BINDER

Binders that are suitable for the process of the invention can be available as colloidal solutions or dispersions such as homo- and copolymerizates, based on vinyl acetate and crotonic acid or partially saponified poly(-meth)acrylates. Preferred are homo- and copolymerizates from acrylic acid and/or methacrylic acid in the form of their sodium salts.

As a pure acid, the binder is not water soluble and must be transformed to a solvation state suitable for coacervation. To this end, there must be an adequate portion of the carboxyl groups in the form of carboxylate groups. They bring about the solvation of the polymerizate with water, so that it is in the truly dissolved or at least in the colloidally dissolved state. Real solutions are largely clear. Colloidal solutions are characterized by a more or less distinct cloudiness. If the polymer still contains carboxyl groups that are not yet neutralized, a colloidal, slightly cloudy solution can be converted into a real solution through further neutralization.

The necessary solvation state is reached by means of an adequate percentage of carboxylic groups in the polymer. In the case of polymers with a high carboxyl group content sometimes just a partial neutralization of the carboxyl groups into carboxylate groups suffices, whereas for copolymers with a low carboxyl group content usually total neutralization is necessary. If the carboxyl group content is too low, no adequate solvation can be achieved even with total neutralization.

The carboxylate content required for adequate solvation depends on the hydrophilicity of the whole polymerizate. As a rule it ranges from 3 to 10 wt. % calculated as COO- and based on the weight of the non-neutralized polymerizate. If the polymerizate is synthesized totally or predominantly from units of an ethylenically unsaturated, radically polymerizable carboxylic acid, total neutralization is advantageous, of course, but not mandatory. Depending on the degree of neutralization, the pH value of the binder solution ranges from about 8 to 11.

To neutralize the carboxyl to carboxylate groups, in principle any base that contains monovalent cations is suitable. Aqueous alkali, in particular a sodium hydroxide solution, is preferred for economic reasons.

In general the percentage of ethylenically unsaturated, radically polymerizable carboxylic acid should be no less than 6 and no more than 80 wt. %, preferably 10 to 80 wt. %, in particular.20 to 80 wt. %. Acrylic and/or methacrylic acid and maleic acid are preferred; also suitable are fumaric, itaconic or crotonic acid.

As comonomers readily or slightly water-soluble, ethylenically unsaturated, radically polymerizable monomers can be involved in the synthesis of the polymerizate. Ethylene and alkyl esters of acrylic acid and/or methacrylic acid, in particular with 1 to 4 carbon atoms in the alkyl group, have an advantageous effect. Their percentage ranges preferably from 20 to 90 wt. %, in particular preferably from 20 to 80 wt. %. Other usable comonomers are. e.g., styrene, acrylonitrile or vinyl acetate. Stronger hydrophilic or water-soluble comonomers such as acryl- and/or methacrylamide or hydroxyalkyl ester of acrylic acid and/or methacrylic acid can also be used in percentages up to a total of about 30 wt. %, preferably up to 10 wt. %. Finally small percentages of crosslinking comonomers with two or more ethylenically unsaturated, radically polymerizable groups in the molecule such as ethylene glycol-diacrylate and ethylene glycol-dimethacrylate, allyl acrylate and allyl methacrylate, can be involved in the synthesis of the polymerizate. However, their percentage must be low enough to allow still adequate solvation, for example up to 3, preferably up to 1. in particular up to 0.1 wt. %.

A satisfactory effect as a binder requires an adequate molecular weight of the polymerizate. In general the molecular weight is supposed to amount to at least 20,000, preferably 50,000 to 1 million, determined as weight average. Still higher molecular weights lead to high viscosities, which render the use on papermaking machines more difficult, without being necessary for the bonding effect. As an aqueous solution set to pH 9 with a sodium hydroxide solution, preferred binders have at a concentration of 200 g/l and 20° C. a viscosity of more than 100, in particular more than 1,000 mPa s. This viscosity is already reached by very high molecular binders at a concentration of about 30 g/l.

Based on the weight of the dry pigment, the binder is added expediently in a quantity ranging from 1 to 11, preferably from 2 to 5 wt. %. calculated as a pure, unneutralized polymerizate.

THE PIGMENT

The process of the invention can be performed with all customary pigments used in the papermaking industry. The term "pigment" includes all customary fillers used in the papermaking industry. Inorganic, in particular acid resistant pigments are preferred. This includes kaolin, talcum, calcium carbonate, calcium sulfate, silicic acid, barium sulfate, titanium dioxide, and mixtures thereof. Kaolin and talcum are especially preferred. As a rule the particle size of at least 50 wt. % of the pigment particles ranges from 0.1 to 10, preferably from 0.3 to 5 micrometers. The majority of the pigments has in the aqueous slurry a negative zeta potential, thus is in the anionic state.

THE ACIDIFYING AGENT

By this term is understood all agents that exhibit an adequate acidic effect and with which the pH value of the binder solution can be reduced from the initial value ranging from 8 to 11 to values ranging from about 4 to 8. As a rule they are low molecular, in particular inorganic acidic compounds. They include mineral acids such as sulfuric acid. Preferably acidically reacting salts such as alkali hydrogen sulfate or in particular aluminum sulfate that is usually called alum in the papermaking industry are added.

The quantity of the acidifying agent is critical, so that the desired state of coacervation is reached and a shift of the electric charge of the pigment is avoided. The pH value of the treated suspension depends on the kind of polymer. Polymers with high carboxyl group content reach the optimal coacervation state at lower pH values, namely about pH 5 to 6, than polymers with low carboxyl group content, which reach their best binding strength at about pH 7 to 8. If a mineral acid is used as the acidifying agent, the equivalent quantity of acid added is below the equivalent quantity of the carboxylate groups of the polymer. When using aluminum sulfate, which reacts acidically as a consequence of hydrolysis, a stoichiometric calculation of the need for acidifying agent is hardly possible.

In the case of the preferred poly(meth)acrylates, coacervation takes place in such a manner that the binder solution exhibiting a pH value in the alkaline range is acidified—preferably with aluminum sulfate, resulting in the destruction of the colloid system at a specific pH value and the precipitation of the binder.

PREFERRED METHOD

The inorganic pigment is suspended in a concentration ranging from 2 to 30 wt. %, preferably from 2 to 20 wt. %, in water. Customary dispersants such as polyphosphates can be used, provided they do not interfere with the coacervation. The pH value of the suspension is set to the pH value of the binder solution. While stirring, the binder is stirred as an aqueous solution into the suspension and uniformly distributed. Then an aqueous solution of the acidifying agent is gradually stirred in while avoiding local over-acidification, thus triggering the coacervation.

Before or after coacervation, the suspension is added to the fibrous material. All fibrous materials that are customary for the manufacture of paper such as mechanical pulp, chemical pulp, semi-chemical pulp, high yield pulp, recycled papers can be used. When adding the pigment suspension, the fibrous material has preferably a solid content ranging from 3 to 4 wt. % and is diluted with backwater to 0.1 to 1 wt. % prior to the formation of the sheet. Suitably, the mixing is done directly in the proportioning system of a papermaking machine. Customary additives—such as defoamers, dispersants, thickeners, retention aids, optical brighteners, dyes, fungicides, bactericides, lubricants—can be used in the usual quantities. All aforementioned process steps can be conducted at temperatures customary in the manufacture of paper. The total furnish is subsequently formed in the conventional manner into a sheet and, thereafter can be calendared.

When acid-sensitive pigments are used such as calcium carbonate, it can be advantageous to initiate coacervation in the absence of the pigment, to emulsify finely the resulting coacervate, optionally heating gently, and then to add the pigment and the fibrous material.

Preferably papers with a substance weight of 32 to 170 g/m$^2$ are produced. They have the quality of known SC papers or even exceed them. They are especially suitable as printing papers.

EXAMPLES a) General method

A 5% suspension of kaolin in water is set to pH 11 with a sodium hydroxide solution. Then an alkaline solution of the binder is added while stirring. This mixture is mixed with the fibrous material, comprising a spruce sulphite pulp and ground-wood pulp in a ratio of 1:1, in the proportioning system of a papermaking machine, so that the result is a solid content of 0.5 wt. %. Then so much aluminum sulfate is added until the pH value specified in Table 1 is reached. By measuring the zeta potential it is determined whether the pigment exhibits a negative surface charge. Thereafter the compound is formed in the conventional manner into a sheet and subsequently calendared. The breakings length is measured on the finished paper.

b) Binders used

Aerosol A 40D (trade name of BASF AG, Ludwigshafen):

Aqueous anionic dispersion of a copolymerizate based on acrylic acid, acrylic acid ester and vinyl acetate. The alkali requirement to achieve a solution of pH 7.5 amounts to 8.2 wt. % of NaOH, (based on the polymerizate weight), resulting in an acrylic acid content of about 15 wt. %.

Rohagit S mV (trade name of Rohm GmbH, Darmstadt): Powdery alkali-soluble acrylic resin with an acid number ranging from 405 to 440 mg of KOH/g. A 3% aqueous solution set to a pH 9 with NaOH has a viscosity of about 4,000 mPa s.

Binder 3: 45% aqueous dispersion of a copolymerizate comprising vinyl acetate and 6 wt. % acrylic acid.

Binder 4: 30% aqueous dispersion of a copolymerizate comprising 69.8% ethyl acrylate, 30% methacrylic acid, 0.2% ethylene glycol dimethacrylate; viscosity 1%, set to pH 9 with NaOH: 6,000 mPa s.

Binder 5: powdery copolymerizate comprising 30% styrene and 70% methacrylic acid; viscosity of the 20% solution neutralized with ammonia about 7,000 mPa s.

Binder 6: 25% aqueous solution, Na salt of a copolymerizate comprising 34% butyl acrylate, 31% acrylonitrile, 24% methyl methacrylate, 2% ethyl acrylate, 7.8% methacrylic acid, 0.2% acrylic acid; pH 8.5. viscosity 3.000 mPa s.

Binder 7: 25% aqueous solution of a copolymerizate comprising ethylene and acrylic acid 80:20 wt. %.

c) Test series and results: see Table I

Tests 1, 2 and 16 were conducted as blank tests without the addition of binder in order to have a comparison basis for the breaking length with identical pigment content, but without binder.

| No. | Binder | Binder [%] | pH of pigment suspension | Pigment/fiber ratio |
|---|---|---|---|---|
| 1 | — | — | 7 | 68/32 |
| 2 | — | — | 7 | 78/22 |
| 3 | Acrosol A 40D | 1 | 7 | 78/22 |
| 4 | Acrosol A 40D | 1 | 6 | 68/32 |
| 5 | Acrosol A 40D | 1 | 5 | 78/22 |
| 6 | Acrosol A 40D | 4 | 7 | 68/32 |
| 7 | Acrosol A 40D | 4 | 6 | 68/32 |
| 8 | Acrosol A 40D | 4 | 5 | 68/32 |
| 9 | Acrosol A 40D | 4 | 7 | 78/22 |
| 10 | Acrosol A 40D | 4 | 6 | 78/22 |
| 11 | Rohagit S,mv | 1 | 5.5 | 68/32 |
| 12 | Rohagit S,mv | 1 | 5.5 | 78/22 |
| 13 | Rohagit S,mv | 1 | 5.5 | 68/32 |
| 14 | Rohagit S,mv | 1 | 5.5 | 78/22 |
| 15 | Binder 3 | 4 | 5.5 | 68/32 |
| 16 | — | — | 5.5 | 68/32 |
| 17 | Binder 4 | 4 | 5.5 | 68/32 |
| 18 | Binder 5 | 4 | 5.5 | 68/32 |
| 19 | Binder 6 | 4 | 5.5 | 68/32 |
| 20 | Binder 7 | 4 | 7.5 | 68/32 |

| Number | Filler content [%] | Breaking length [m] | zeta potential [mV] |
|---|---|---|---|
| 1 | 36.2 | 1220 | negative |
| 2 | 42.4 | 950 | negative |
| 3 | 42.7 | 1050 | negative |
| 4 | 38.2 | 1200 | negative |
| 5 | 49.1 | 790 | negative |
| 6 | 33.4 | 1610 | negative |
| 7 | 39.7 | 1300 | negative |
| 8 | 39.7 | 1240 | negative |
| 9 | 41.6 | 1340 | negative |
| 10 | 39.1 | 1240 | negative |
| 11 | 31.7 | 1520 | −32.4 |
| 12 | 38.2 | 1240 | negative |
| 13 | 41.9 | 1320 | negative |
| 14 | 49.9 | 950 | negative |
| 15 | 41.7 | 1720 | negative |
| 16 | 38.2 | 635 | negative |
| 17 | 35.8 | 1127 | negative |
| 18 | 33.7 | 1182 | negative |
| 19 | 39.5 | 1009 | negative |
| 20 | 42.3 | 861 | negative |

The test values 3 to 15 are based on the blank tests 1 and 2. Tests 17 to 20 are based on the blank test no: 16.

What is claimed as new and desired to be secured by Letters Patent of the United States is:

1. A process for the treatment of a pigment, suspended in water, with an aqueous binder through precipitation of the binder on the pigment, consisting essentially of gradually adding an acidifying agent to a dissolved binder, the binder being a high molecular polymerizate of an ethylenically unsaturated, radically polymerizable carboxylic acid that is solvated by means of carboxylate groups, avoiding local over-acidification, until the binder coacervates and the coacervate precipitates on a suspended pigment, wherein the quantity of the acidifying agent is limited in such a manner that the pigment retains a negative charge.

2. A process for manufacturing pigment-containing paper through sheet formation from an aqueous stock, wherein said stock contains a pigment treated according to claim 1.

3. A process according to claims 1 or 2, wherein kaolin, calcium sulfate, talcum or titanium dioxide is added as the pigment.

4. A process according to claims 1 or 2, wherein a polymerizate having a molecular weight Mm > 20,000 is added as the binder.

5. A process according to claim 4, wherein a polymerizate having a molecular weight Mm > 50,000 is added as the binder.

6. A process according to claim 4, wherein a polymerizate containing 6 to 80 wt. % of an ethylenically unsaturated, radically polymerizable carboxylic acid selected from the group consisting of acrylic acid, methacrylic acid, and maleaic acid is added as the binder.

7. A process according to claim 6, wherein the polymerizate contains 10–80 wt. % of said ethylenically unsaturated, radically polymerizable carboxylic acid.

8. A process according to claims 1 or 2, wherein an acid reacting salt of a polyvalent metal cation is added as the acidifying agent.

9. A process according to claim 8, wherein aluminum sulfate is added.

10. An aqueous suspension of a pigment for the paper making industry wherein the treated pigment is made by a process according to claim 1.

11. An aqueous suspension according to claim 10, wherein the aqueous phase has less than 5 wt. % of the binder.

12. An aqueous suspension as claimed in claim 11, wherein the content of the binder in the aqueous phase amounts to no more than 10 wt. %, based on a total binder content of the suspension, following high shear treatment of 3 minutes by means of a high speed agitator at 4,000 rpm.

* * * * *